US005245968A

United States Patent [19]

Kolias et al.

[11] Patent Number: 5,245,968

[45] Date of Patent: Sep. 21, 1993

[54] SYSTEM TO DETERMINE CAM PHASE AND CYLINDER IDENTIFICATION FOR A VARIABLE CAM TIMING ENGINE

[75] Inventors: Tom T. Kolias, Dearborn Heights; Hsien C. Pao, Plymouth, both of Mich.

[73] Assignee: Ford Motor Company, Dearborn, Mich.

[21] Appl. No.: 924,811

[22] Filed: Aug. 4, 1992

[51] Int. Cl.[5] ..... F02P 5/00

[52] U.S. Cl. ..... 123/414; 123/90.15

[58] Field of Search ..... 123/90.15, 90.17, 90.18, 123/90.11, 414, 416, 419; 73/116; 364/431.03, 431.05

[56] References Cited

U.S. PATENT DOCUMENTS

| | | | |
|---|---|---|---|
| 4,365,602 | 12/1982 | Stiller et al. | 123/414 |
| 4,459,968 | 7/1984 | Brandt et al. | 123/617 |
| 4,485,784 | 12/1984 | Fujii et al. | 123/414 |
| 4,615,318 | 10/1986 | Imoto et al. | 123/414 |
| 4,700,305 | 10/1987 | Lotterbach et al. | 364/431.03 |
| 4,825,373 | 4/1989 | Nakamura et al. | 364/431.05 |
| 4,873,958 | 10/1989 | Abe | 123/424 |
| 4,899,281 | 2/1990 | Grimaud et al. | 364/431.04 |
| 4,909,194 | 3/1990 | Bauer | 123/90.15 |
| 4,924,830 | 5/1990 | Abe | 123/414 |
| 4,926,822 | 5/1990 | Abe et al. | 123/414 |
| 4,928,640 | 5/1990 | Van Vuuren et al. | 123/90.17 |
| 4,945,870 | 8/1990 | Richeson | 123/90.11 |
| 4,953,531 | 9/1990 | Abe | 123/414 |
| 4,989,448 | 2/1991 | Fukui et al. | 73/116 |
| 4,995,351 | 2/1991 | Ohkubo et al. | 123/90.11 |
| 5,056,360 | 10/1991 | Dosdall et al. | 73/116 |
| 5,099,811 | 3/1992 | Frantz et al. | 123/416 |
| 5,117,784 | 6/1992 | Schechter et al. | 123/90.17 |
| 5,144,920 | 9/1992 | Imperial | 123/90.31 |
| 5,156,125 | 10/1992 | Fukui et al. | 123/414 |
| 5,168,853 | 12/1992 | Kittleson et al. | 123/419 |

*Primary Examiner*—Raymond A. Nelli

*Attorney, Agent, or Firm*—Roger L. May; Peter Abolins

[57] ABSTRACT

A detection system and method for determining the phase relationship between a crankshaft and one or more independently phase shiftable camshafts which the system integrates into camshaft and cylinder identification sensors for determining both cam location for variable cam phasing, and for generating a cylinder identification signal uniquely identifying one of the cylinders, for sequential fuel injection, thus reducing: (i) the number of sensors needed to operate the system to a single crankshaft sensor and a single sensor for each camshaft; and (ii) the number of high-speed inputs needed on the on-board engine control unit microprocessor. The number of sensing teeth on the independent cam wheels vary depending upon the number of cylinders and the number of independently phase shiftable camshafts in the engine. Each sensing tooth is associated with one of the engine's cylinders and one cam wheel contains an extra cylinder identification tooth associated with a selected cylinder.

7 Claims, 4 Drawing Sheets

SYSTEM TO DETERMINE CAM PHASE AND CYLINDER IDENTIFICATION FOR A VARIABLE CAM TIMING ENGINE

TECHNICAL FIELD

This invention relates to variable cam timing engines, particularly to systems and method of operation for determining cam phase angle and generating a cylinder identification signal.

BACKGROUND OF THE INVENTION

Typically, in conventional internal combustion engines, the timing between the camshaft and crankshaft is rotationally fixed. More recent engine designs have provided mechanisms to vary this timing in order to maximize fuel economy and minimize harmful emissions emitted from the engine's exhaust.

In order to accomplish this, the overall system must incorporate some type of sensing system to determine the existing phase relationship of the camshaft to the crankshaft, in order to determine the relative change in the phase between the two to maximize fuel economy and minimize harmful emissions. This usually is accomplished with separate sensors on the crankshaft and each independently phase shiftable camshaft, by transmitting these signals to an on-board microprocessor, to generate a phase correction signal. A phase shifting mechanism is activated by the phase correction signal to accomplish the desired result.

Additionally, more engines are designed with sequential fuel injection. The purpose of such an engine design improvement is to increase fuel economy and reduce harmful emissions. This typically is accomplished by configuring a system to sense the rotational position of the camshaft, and by adding a sensor to generate a cylinder identification signal (i.e. engine rotational position). This cylinder identification signal is then sent to an on-board microprocessor, which determines the proper sequential timing of the fuel injection into each cylinder.

Despite these developments, there exists a need to reduce the number of parts or components in such systems, and to reduce the number of process steps being performed, all of which should result in improvements in cost and reliability. In order to reduce the number of sensors needed, and correspondingly to reduce the number of high speed inputs into an on-board microprocessor, a system is needed which can integrate these two functions and yet still perform both the phase shift and the sequential fuel injection functions adequately.

SUMMARY OF THE INVENTION

The present invention contemplates a system and method of operation for determining the phase between a crankshaft and several independently phase shiftable camshafts which can be used to control both independent camshaft phase shifting and sequential fuel injection.

The present invention further contemplates a crankshaft sensor, for generating crankshaft position signal which is transmitted to an electronic distributorless ignition system (EDIS) microprocessor. The distributorless ignition system microprocessor reads the crankshaft position signals, generates a profile ignition pick-up (PIP) signal, and then transmits it to the engine control unit (ECU) microprocessor. This profile ignition pick-up signal is compared with the signals from the camshaft sensors to determine relative phase shifts between a crankshaft and independently phase shiftable camshafts. This phase shift is compared with a desired phase shift generated by the engine control processor to determine the difference. The engine control unit microprocessor will generate from this difference a camshaft phase shift signal which activates independent variable cam timing mechanisms to phase shift the camshaft to establish the derived phase relationship between the camshafts and the crankshaft. In the present embodiments, the signals from each camshaft sensor is received at an independent high speed input of the engine control unit processor.

In an alternative embodiment, the signals from the camshaft sensors are electrically combined using an OR circuit and are received by the ECU microprocessor through a single high-speed input, reducing the number of high-speed inputs into the ECU microprocessor.

In an additional alternative embodiment, the number of teeth for sensing the camshaft location and position double on each cam wheel to increase the sampling rate of the camshaft position. This is especially useful on engines with fewer cylinders operating at low engine speeds.

The present invention also contemplates a method of operating the above described system which includes detecting the cam and cylinder identification tabs on the camshaft pulse wheels to generate a camshaft signal having a cam positional component and a cylinder identification component, and transmitting the resulting signals to the ECU microprocessor Simultaneously, crankshaft position designations on the crankshaft sprocket are detected to generate a crankshaft signal which is transmitted to the EDIS microprocessor. The EDIS microprocessor in turn reads this signal to create a PIP signal transmitted to the ECU microprocessor. Using the PIP signal as a reference along with the CID signal, the ECU microprocessor next identifies cylinder number 1 and calculates the phase between the crankshaft and each independently phase shiftable camshaft. This information is then used for generating and transmitting a sequential fuel control timing signal to sequence the fuel injectors and also generates and transmits a cam phase shift signal to the camshaft phase shift mechanisms corresponding to a desired phase angle relationship to be established between the camshaft and crankshaft for a desired engine performance.

The features, objects and other advantages, of the present invention are readily apparent from the following detailed description of the best mode for carrying out the invention when taken in connection with the accompanying drawings.

BEST MODE FOR CARRYING OUT THE INVENTION

Figure 1:
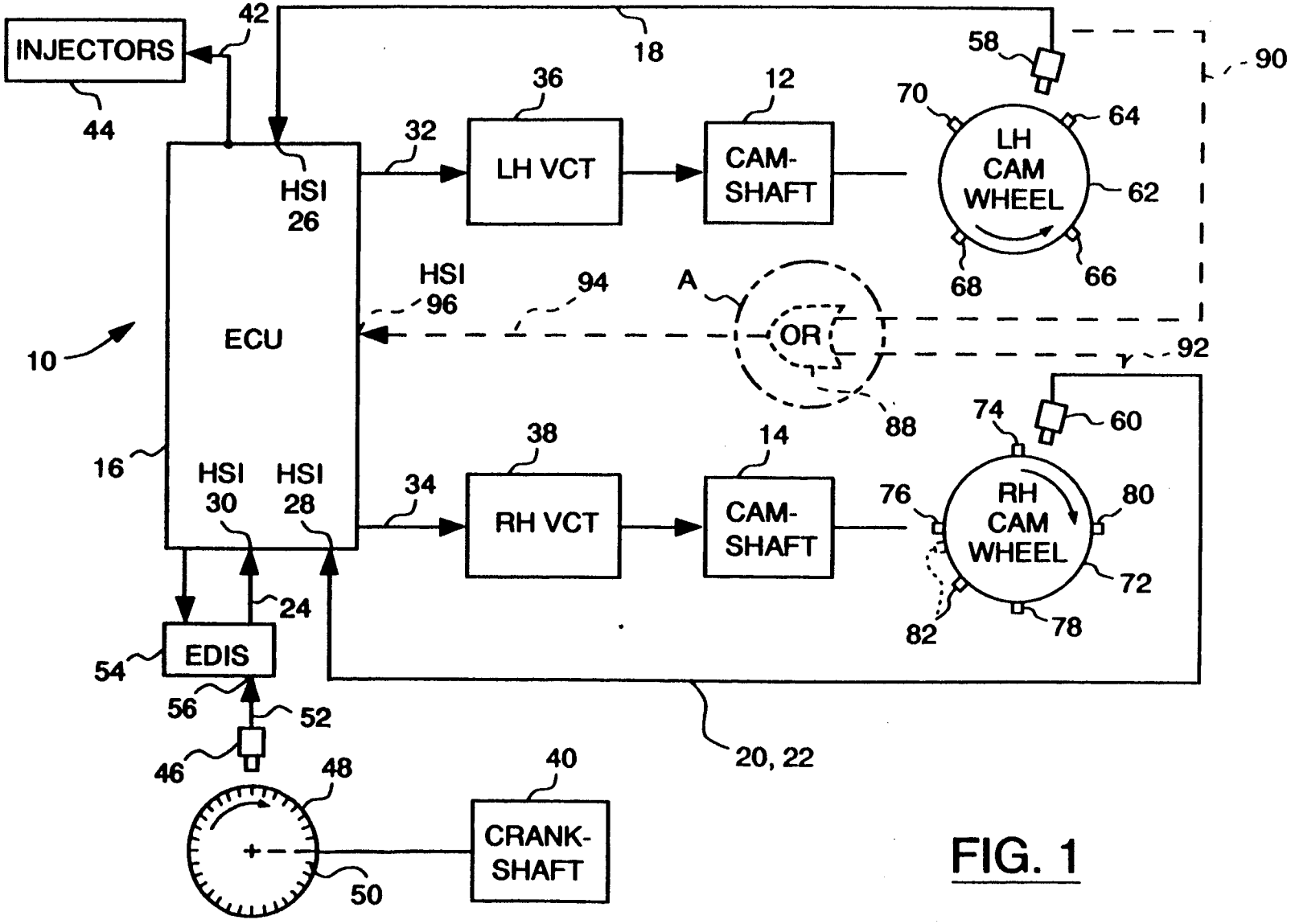
FIG. 1 is a block diagram of a control circuit for sensing relative position of a crankshaft and two independently phase shiftable camshafts, for camshaft phase shifting and sequential fuel control.

Referring to the drawings, FIG. 1 is a general block diagram of a cam phase and cylinder identification system 10, as a first embodiment for use with an eight-cylinder engine The engine, not shown, has two independently phase shiftable camshafts 12, 14. The cam phase and cylinder identification system consisting of a first microprocessor such as an engine control unit (ECU) microprocessor 16, to process the cam signals 18, 20, cylinder identification (CID) signal 22 and the profile ignition pick-up (PIP) signal 24, received through three high speed inputs 26, 28, 30 respectively.

The ECU microprocessor 16 is electrically connected to the left-hand variable cam timing mechanism (LH-VCT) 36 and right-hand variable cam timing mechanism (RH-VCT) 38, through the variable cam timing signal leads 32, 34, respectively. Throughout this specification, reference to an "independent camshaft" or "independent camshafts" means an independently phase shiftable camshaft wherein its phase angle relative to the crankshaft can be adjusted by a suitable mechanism, such as shown in U.S. Pat. No. 5,117,784 to Schachtar, et al, assigned to the assignee of the present invention, or any other rotary shaft phase shift mechanism known in the art. These variable cam timing mechanisms 36, 38 are independently connected to the left-hand camshaft 12 and right-hand camshaft 14, respectively, in such a way so as to allow phase shifts relative to the crankshaft 40.

Further the ECU microprocessor 16 is electrically connected by the vehicle wiring harness 42 to the fuel injectors 44.

The PIP signal 24 is generated by the EDIS microprocessor 54 from the crankshaft signal generated by the crankshaft sensor 46 reading the crankshaft sprocket 48. A preferred embodiment of the camshaft sprocket consists of thirty-five gear teeth 50 spaced ten degrees apart which result in one tooth missing, that the crankshaft sensor 46 uses for sensing the position of the crankshaft sprocket 48. The crankshaft sprocket 48 is rotationally fixed relative to the crankshaft 40. The crankshaft signal 52 is electrically transmitted to a second microprocessor such as an electronic distributorless ignition system (EDIS) microprocessor 54 through a high-speed input 56, which converts the crankshaft signal 52 into the PIP signal which is then electrically transmitted on lead 24 to a high-speed input 30. A PIP pulse occurs at evenly spaced rotational intervals of the engine's crankshaft with one pulse per cylinder per engine cycle. This series of PIP pulses constitute the PIP signal.

The left-hand cam signal 18, and right-hand cam signal 20 along with the CID signal 22 are generated by the left-hand cam sensor 58 and right-hand cam sensor 60 respectively. These signals 18 and 20, 22 are received by the ECU microprocessor 16 through high-speed inputs 26 and 28 respectively. "Left-hand" and "right-hand" is merely used herein as a convenient manner of distinguishing one camshaft from a second camshaft.

Figure 2:
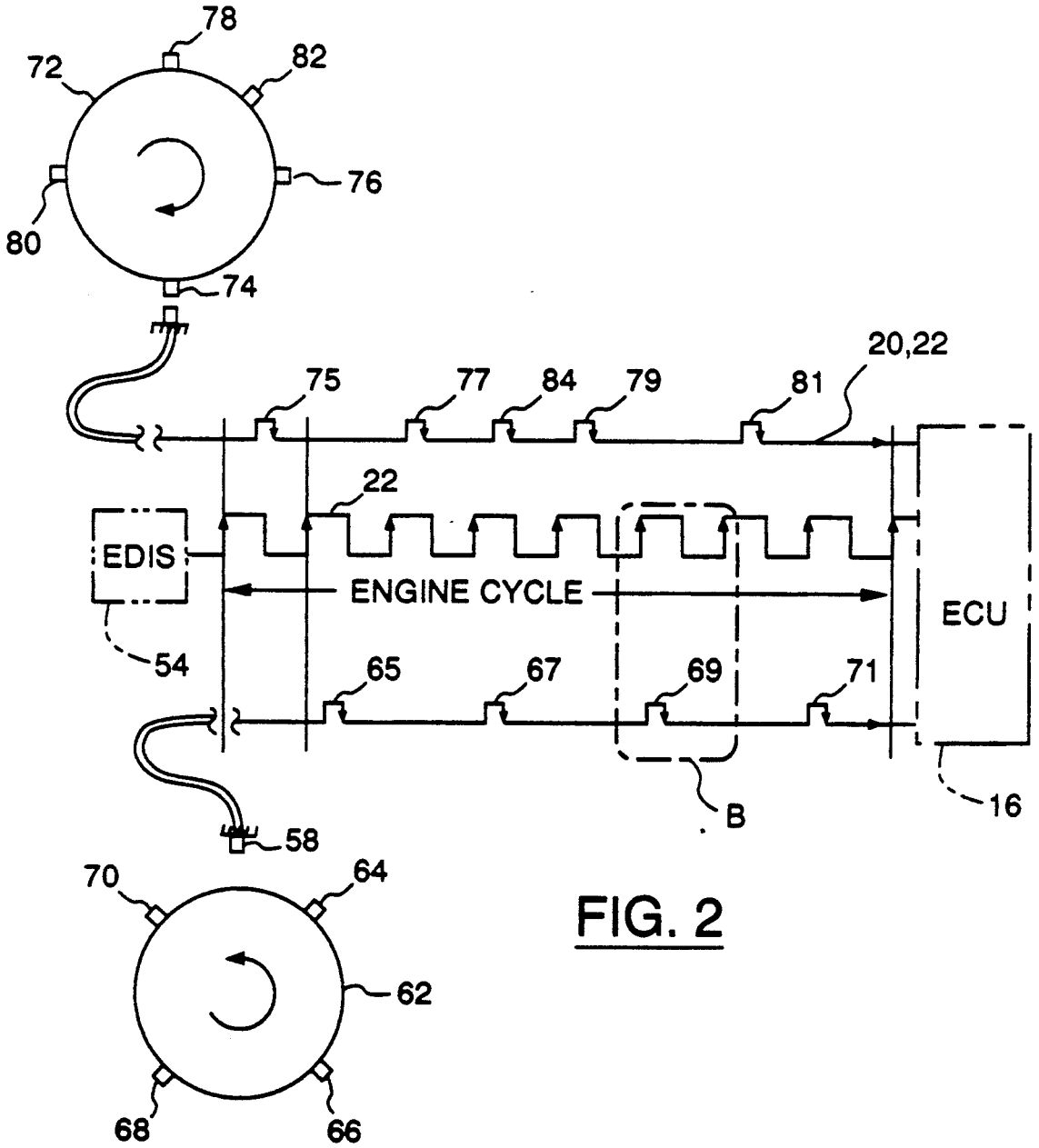
FIG. 2 is a schematic diagram showing the relative positions of the crankshaft profile ignition pick-up (PIP) signal and the cam pulses from the camshaft pulse wheels, for one engine cycle of an eight cylinder engine with two independently phase shiftable camshafts, in accordance with the present invention.

Referring to FIGS. 1 and 2, the timing of the cam signals 18, 20 and CID signals 22 relative to each other and the PIP signal 24 is shown for one complete engine cycle. The number of pulse wheels is equal to the number of independently phase shiftable camshafts in the engine The number of equally spaced position indicating devices, such as cam pulse wheel tabs, per pulse wheel is equal to the number of cylinders in the engine, divided by the number of independently phase shiftable camshafts (always an integer). When there are more than one pulse wheel only one has an additional CID tab.

In the first embodiment, as the left-hand camshaft pulse wheel 62 which is fixed rotationally to the left-hand camshaft 12 rotates, four cam tabs 64, 66, 68, 70 equally spaced ninety degrees around the periphery and fixed to the left-hand cam pulse wheel 62, pass by the left-hand cam sensor 58, fixed relative to the engine. The left-hand cam sensor 58 detects the passing of each and generates the respective cam pulses or position signals 65, 67, 69, 71 which are received by the ECU microprocessor 16.

As the right-hand camshaft pulse wheel 72, which is fixed rotationally to the right-hand camshaft 14 rotates, four cam pulse wheel tabs 74, 76, 78, 80 equally spaced at ninety degrees to the right-hand cam pulse wheel 72, pass by the right-hand cam sensor 60 fixed relative to the engine. The right hand cam sensor 60 senses the passing of each tab and generates respective electric cam pulses or position signals 75, 77, 79, 81 which are received by the ECU microprocessor 16. In addition, the right-hand cam pulse wheel has a cylinder identification (CID) tab 82, fixed to the right-hand cam pulse wheel 72, half-way between two right-hand pulse wheel tabs 76,78 which, as it passes by the sensor 60, causes the sensor 60 to generate a CID pulse 84 which is received along with the right-hand cam pulses by the ECU microprocessor 16.

The ECU microprocessor 16 then compares these signals, to determine the relative phase angle relationship, for controlling the variable cam timing and sequential fuel injection. The ECU microprocessor 16, after calculating the necessary phase shift, will send variable cam timing signals 32, 34 to activate the left-hand variable cam timing mechanism 36 and right-hand variable cam timing mechanism 38, respectively Once activated, these variable cam timing mechanisms 36, 38, will independently shift the phase of the left-hand camshaft 12 and right-hand camshaft 14, respectively, relative to the crankshaft 40 in order to provide the proper phase relationship for the given engine operating condition. Further, the ECU microprocessor 16 identifies cylinder number 1 and starts the correct injection sequence.

Figure 6:
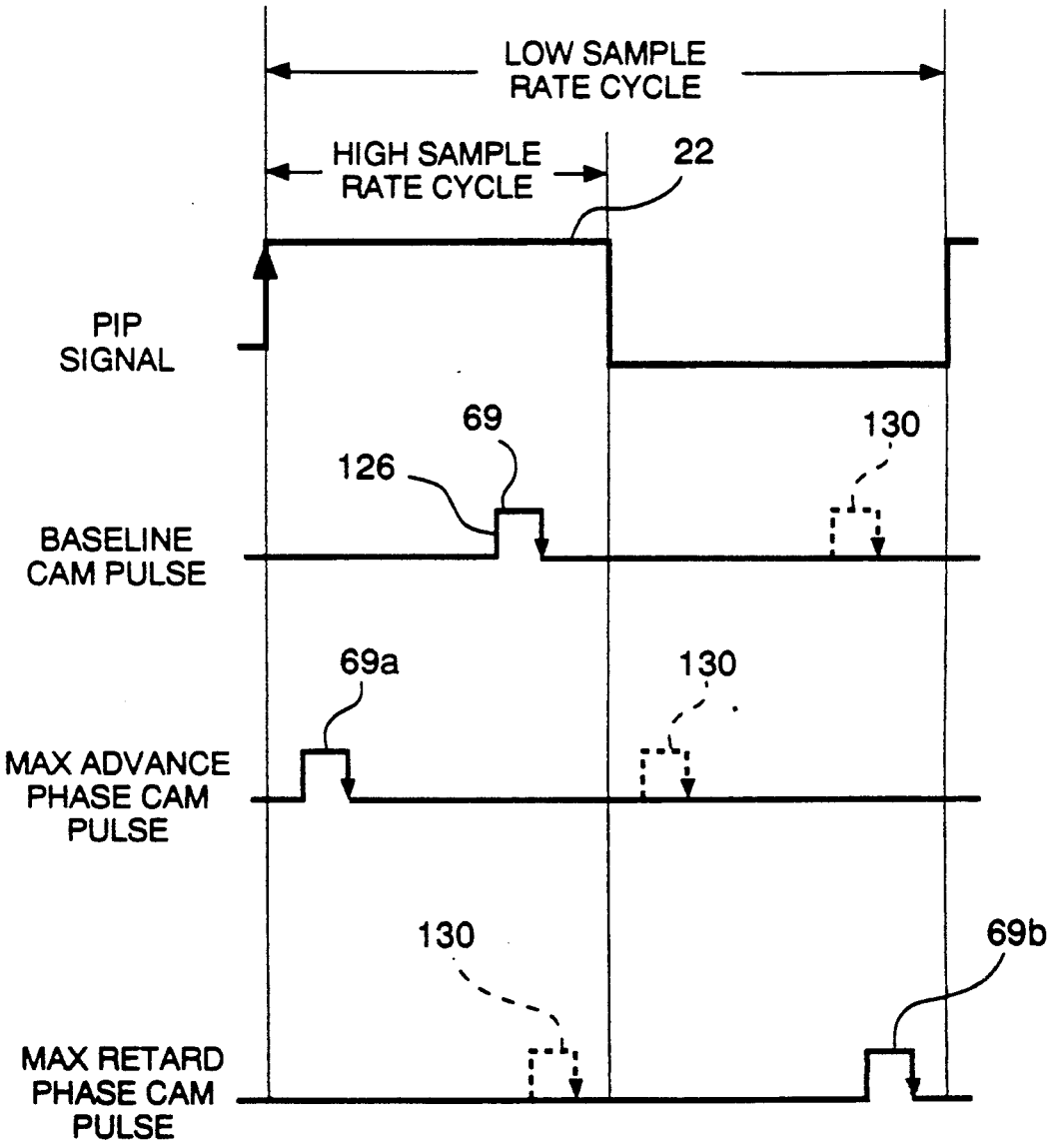
FIG. 6 is a graph showing the relative cam phase signal in advance and retard positions, relative to the PIP signal as taken from the encircled area designated "B" in FIG. 2.

FIG. 6 along with FIGS. 1 and 2, shows the phase relationship between the PIP signal 22, and a corresponding cam pulse 69 as shown in a baseline position. In this embodiment, the trailing edge 126 of the cam pulse 69 is the relevant edge for timing purposes, although the leading edge could also have been used.

Should the phase angle of the camshaft 14 be advanced relative to the crankshaft 40 by the system 10 in the pre-determined maximum amount, then the cam pulse will be advanced relative to the PIP signal 22 the position shown as 69*a*. Likewise, should the phase angle of the camshaft 14 be retarded relative to the crankshaft 40 in the pre-determined maximum amount, then the cam pulse 69*b* will be retarded relative to the PIP signal 22 to the position shown as 69*b*.

Figure 3:
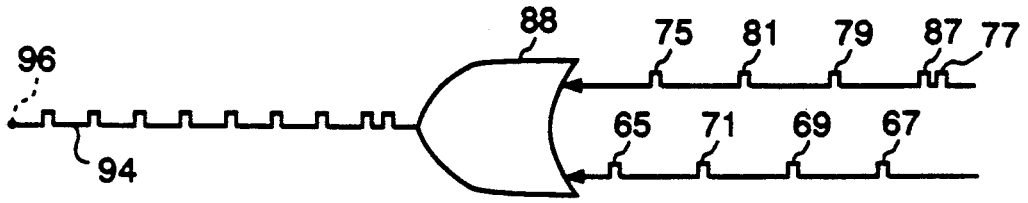
FIG. 3 is a schematic diagram showing the combination of signals from two independent camshaft sensors, through an OR circuit to one signal fed into a single high-speed input on the ECU microprocessor, as taken from the encircled area designated "A" in FIG. 1 in accordance with the present invention.

A first alternative control circuit is shown by the dashed lines in FIG. 1 and details are shown on FIG. 3. The left-hand cam pulse wheel 62 and sensor 58 are the same as the first embodiment. On the right-hand cam pulse wheel 72 the tabs 74, 76, 78, 80 are the same as in the embodiment first discussed, however, the CID tab 82 is now located adjacent to a cam tab 76 as shown on FIG. 1. The right-hand and left-hand cam pulses 90, 92 are electrically combined by means of an OR circuit 88 into a single electronic signal 94, as shown in FIG. 3. The electrically combined signal 94 is received by the ECU microprocessor 16, through a single high-speed input 96, thus reducing the number of high-speed inputs into the ECU microprocessor 16.

Figure 4:
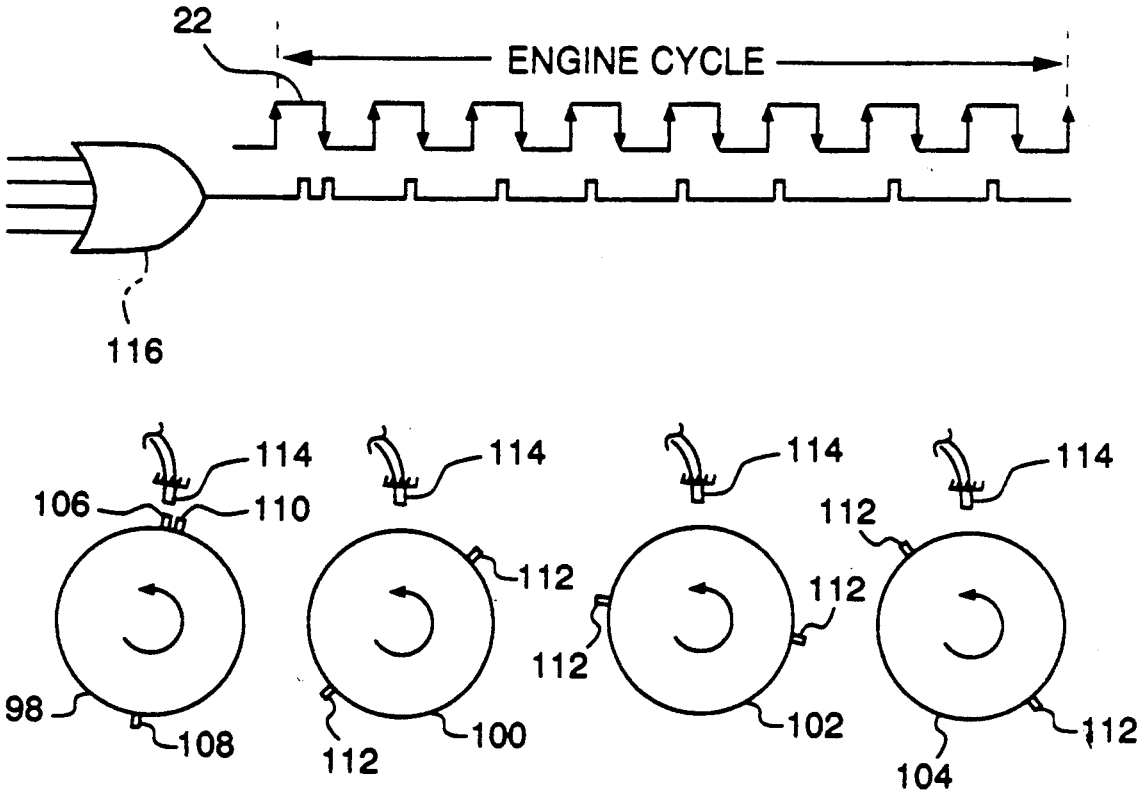
FIG. 4 is a schematic diagram showing four independent camshaft pulse wheels and the resulting signal pulses sent to the ECU microprocessor, along with PIP signal for one engine cycle of an eight cylinder engine in accordance with the present invention.

A second alternative embodiment is shown in FIG. 4. In this embodiment, there are four cam pulse wheels 98, 100, 102, 104 each rotationally fixed to one of four independently phase shiftable camshafts in an eight-cylinder engine. The first pulse wheel 98 has two cam tabs 106, 108 spaced one hundred and eighty degrees apart. In addition, the cam pulse wheel 98 has a CID tab 110 adjacent to a cam tab 106. This configuration incorporates an OR circuit as in the first alternative embodiment. The other three cam pulse wheels 100, 102, 104 each have two cam tabs 112 spaced one hundred and eighty degrees apart respectively. Each cam pulse wheel 98, 100, 102, 104 has an associated cam sensor 114, which senses the cam tabs and generates an electric signal combined by an OR circuit 116 and received by the ECU microprocessor 16.

Figure 5:
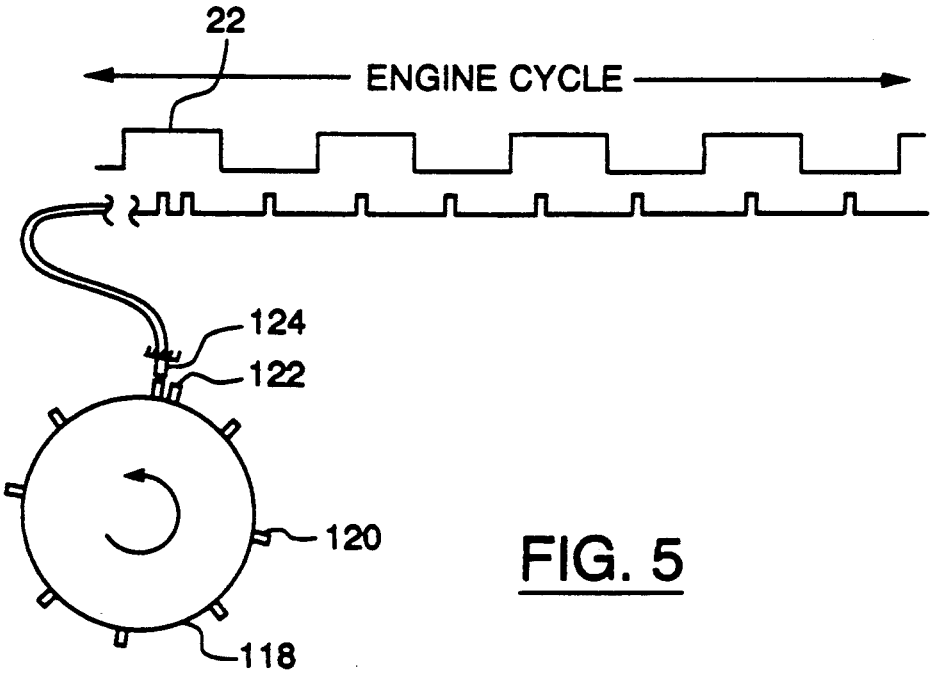
FIG. 5 shows an alternative embodiment to the schematic diagram of FIG. 4, with an independent camshaft phase sensor and its corresponding signal sent to the ECU microprocessor along with the PIP signal for a four cylinder engine with one independent camshaft, with a high sample rate, in accordance with the present invention.

A third alternative embodiment is shown in FIG. 5. In this embodiment, there is only one cam pulse wheel 118 rotationally fixed to a camshaft in a four-cylinder engine. The cam pulse wheel 118 has eight cam tabs 120 spaced forty-five degrees apart and permanently affixed to it. Additionally, one cylinder identification tab 122 is fixed to the cam pulse wheel 118, near one of the cam tabs 120. How near the one cam tab it is placed will vary depending upon the application; 15° separation has been utilized. Any point intermediate any two cam tabs 120 may be appropriate depending upon the engine application and available computer software limitations. The cam sensor 124 senses the cam tabs 120 and generates an electric signal received by the ECU microprocessor 16. In this embodiment, the sample rate is double, in that two cam tab signals occur within each PIP signal 22 rather than one cam tab signal per PIP cycle as in the previous embodiments. This increases the accuracy of the position calculations for an engine with fewer cylinders, especially when running at low engine speeds. The additional cam signals per PIP signal are shown in FIG. 6 by the dashed pulses 130.

The manner of operating with this system, or method of operation, will be self evident from the above description. Briefly, the cam sensors 58, 60 detect the passing of the cam tabs 64, 66, 68, 70, 74, 76, 78, 80 and the cylinder identification tab 82 and generate the resulting cam and cylinder identification signals 18, 20, 22 received by the ECU microprocessor 16. Similarly, the crankshaft sensor 46 detects the crankshaft sprocket teeth 50, and generates the resulting crankshaft signal 52 received by the EDIS microprocessor 54, which in turn reads this signal to generate a PIP signal 24 received by the ECU microprocessor 16. Simultaneously, crankshaft position designations on the crankshaft sprocket are detected to generate a crankshaft signal which is transmitted to the EDIS microprocessor. The EDIS microprocessor in turn reads this signal to create a PIP signal transmitted to the ECU microprocessor. Using the PIP signal as a reference along with the CID signal, the ECU microprocessor next identifies cylinder number 1 and calculates the phase between the crankshaft and each independently phase shiftable camshaft. This information is then used for generating and transmitting a sequential fuel control timing signal to sequence the fuel injectors and also generates and transmits a cam phase shift signal to the camshaft phase shift mechanisms corresponding to a desired phase angle relationship to be established between the camshaft and crankshaft for a desired engine performance.

It will also be noted that the system is readily adapted to providing the means for continuing operation of the vehicle even if the PIP signal is lost. In such case, the cam phase signal can be used as a reference for scheduling the timing of spark ignition and sequential fuel injection. Specifically, the cam phase is defaulted to a predetermined position, namely either maximum advance phase 69*a* or maximum retard phase 69*b*, as shown in FIG. 6. The PIP rising edge associated with each cylinder can be readily calculated from such information.

Although particular embodiments of the present invention have been illustrated in the accompanying drawings and described in the foregoing detailed description, it is to be understood that the present invention is not to be limited to just the embodiments disclosed. For example, this control circuit can be adapted to work with any number of camshafts for a single cylinder engine or for a multiple cylinder engine, including an in-line or V-style arrangements. Numerous rearrangements, modifications and substitutions are possible, without departing from the scope of the claims hereafter.

What is claimed is:

1. A system for determining and adjusting crankshaft and camshaft phase relationship and also determining cylinder identification in an internal combustion engine having at least one independently phase shiftable camshaft, the system comprising:

a cam pulse wheel rotationally fixed to each independently phase shiftable camshaft;

cam position indicating means fixed to the periphery of said cam pulse wheel, where the number of said cam position indicating means (N) is determined by the equation:

$$N = m/n$$

where m is the number of cylinders in the internal combustion engine, and n is the number of independently phase shiftable camshafts, said cam position indicating means spaced equally around the periphery of the cam pulse wheel;

a cylinder identification indicating means fixed to only one of said cam pulse wheels, located intermediate any two of said cam position indicating means;

means for sensing said cam position indicating means, fixed relative to the engine to generate a cam phase signal and for sensing said cylinder indicating means to generate a cylinder identification signal;

a microprocessor, said microprocessor receiving said cam phase signal and said cylinder identification signal at a single high-speed input per each independently phase shiftable camshaft;

means for producing a crankshaft signal indicating the rotational position of the crankshaft;

means for generating a profile ignition pick-up signal in response to said crankshaft signal;

means for changing the phase angle of the camshaft relative to the crankshaft in response to said cam phase signal; and means for controlling the injection timing of a sequential fuel injection mechanism in response to said camshaft signal and said cylinder identification signal.

2. The system of claim 1 wherein said means for producing a crankshaft signal includes a crankshaft pulse wheel;

the crankshaft pulse wheel rotationally fixed relative to the crankshaft, and a crankshaft position indicating means fixed at a pre-determined point on the crankshaft periphery representing a particular piston position in a particular engine cylinder; and crankshaft sensor means for sensing the rotation of said crankshaft pulse wheel to generate a crankshaft signal.

3. The system of claim 1 wherein said at least one camshaft comprises two independent camshafts in an eight cylinder internal combustion engine, and wherein the cam pulse wheels and cam position indicating means comprise:

a first cam pulse wheel fixed rotationally relative to a first camshaft of said two independent camshafts;

four cam tabs spaced equally around the periphery and fixed to said first cam pulse wheel;

a second cam pulse wheel fixed rotationally relative to the second camshaft of said two independent camshafts;

four cam tabs spaced equally around the periphery and fixed to said second cam pulse wheel, such that the angular relationship between the four cam tabs fixed to the first cam pulse wheel and the four cam tabs fixed to the second cam pulse wheel is selected to generate interleaved cam phase signals at equal angular rotational intervals;

a cylinder identification tab fixed to the periphery of the second cam pulse wheel, spaced intermediate two of the four cam tabs.

4. The system of claim 1, wherein said at least one camshaft is one camshaft in a four cylinder internal combustion engine, and wherein the cam pulse wheel and cam position indicating means comprise:

eight cam tabs spaced equally around the periphery and fixed to said one cam pulse wheel, such that two camshaft position signals are produced per every profile ignition pick-up signal; and a cylinder identification tab fixed to the periphery of the cam pulse wheel, spaced intermediate two adjacent cam tabs of said eight cam tabs.

5. A system for determining and adjusting crankshaft and camshaft phase relationship and also determining cylinder identification in a multicylinder internal combustion engine having a sequential fuel injection system and at least one independently phase shiftable camshaft, the system comprising:

at least one rotationally independent cam pulse wheel, each rotationally fixed relative to at least one independently phase shiftable camshaft;

cam position indicating means fixed to the periphery of said at least one cam pulse wheel, the number of cam position indication means (N) is determined by the equation:

$$N=m/n$$

where m is the number of cylinders in the internal combustion engine and n is the number of independently phase shiftable camshafts.

said cam position indicating means spaced equally around the periphery of said cam pulse wheel;

a cylinder identification indicating means fixed to the periphery of only one of said cam pulse wheels and located adjacent any one of the cam position indicating means;

means associated with each cam pulse wheel for sensing the cam position and cylinder identification to generate indicating means, said means for sensing a cam phase signal fixed relative to the engine;

an OR circuit for combining multiple signals to generate an integrated cam phase signal;

a crankshaft pulse wheel rotationally fixed relative to the crankshaft;

means for sensing the rotation of said crankshaft to generate a crankshaft signal;

means for generating a profile ignition pick-up signal in response to said crankshaft signal;

means for generating injection timing signal in response to said integrated cam phase signal and said ignition pick-up signal;

means for varying the phase angle of each camshaft relative to the crankshaft in response to operational parameters of said engine and said integrated cam phase signal; and means for controlling the injection timing of the sequential fuel injection system in response to said integrated cam phase signal.

6. A system for determining and adjusting camshaft and crankshaft phase relationship and also determining cylinder identification in a multiple cylinder internal combustion engine having a sequential fuel injection mechanism, at least one independently phase shiftable camshaft with a corresponding phase shift mechanism, and a mechanism which determines the crankshaft rotational position and from this generates a corresponding profile ignition pick-up signal, the system comprising:

a cam pulse wheel rotationally fixed to each independently phase shiftable camshaft;

cam position indicating means fixed to the periphery of said cam pulse wheel, where the number of said cam position indication means (N) is determined by the equation:

$$N=m/n$$

where m is the number of cylinders in said internal combustion engine, and n is the number of independently phase shiftable camshafts; the cam position indicating means spaced equally around the periphery of said cam pulse wheel;

cylinder identification indicating means fixed to only one of said cam pulse wheels, located intermediate any two of said cam position indicating means;

sensor means for sensing said cam position indicating means fixed relative to the engine to generate a cam phase signal and for sensing said cylinder indicating means to generate a cylinder identification signal; and means for receiving said cam phase signal and said cylinder identification signal, to compare with the profile ignition pick-up signal and determine relative phase relationships of said signals.

7. A method of determining and adjusting camshaft and crankshaft phase relationship and also determining cylinder identification in a multiple cylinder internal combustion engine having at least one phase shiftable camshaft for variable cam timing, the method comprising the steps of:

detecting the cam and cylinder identification position designations on a cam pulse wheel and thereby generating a camshaft signal having a cam positional component and a cylinder identification component;

detecting crankshaft position designations on a crankshaft sprocket and thereby generating a crankshaft signal;

generating sequential fuel control timing signals in response to said positional components and said cam identification component of said camshaft signal;

generating a phase shift signal in response to operational parameters of the engine and said positional component of said camshaft signal and said crankshaft signal, said phase angle signal corresponding to a desired phase angle relationship between the camshaft and the crankshaft for reducing harmful emissions and increasing fuel economy for a desired engine performance;

activating a phase angle mechanism with said phase angle signal to phase shift said camshaft relative to the crankshaft and thereby attaining said desired phase angle; and activating a sequential fuel control mechanism, with said sequential fuel control timing signal, for controlling the injection timing of the sequential fuel injection mechanism.

* * * * *